US007478787B2

(12) United States Patent
Bankston et al.

(10) Patent No.: US 7,478,787 B2
(45) Date of Patent: Jan. 20, 2009

(54) PAIRED MAIN TEE CLIP

(75) Inventors: John D. Bankston, Amherst, OH (US); James A. Fletterick, Olmsted Falls, OH (US)

(73) Assignee: USG Interiors, Inc., Chicago, IL (US)

( * ) Notice: Subject to any disclaimer, the term of this patent is extended or adjusted under 35 U.S.C. 154(b) by 376 days.

(21) Appl. No.: 11/143,827

(22) Filed: Jun. 2, 2005

(65) Prior Publication Data

US 2006/0283132 A1 Dec. 21, 2006

(51) Int. Cl.
*B42F 13/00* (2006.01)
*E04B 9/00* (2006.01)

(52) U.S. Cl. ..... 248/343; 52/506.07; 52/506.08

(58) Field of Classification Search ..... 52/506.01, 52/506.06, 506.07, 506.08, 506.09, 664, 52/665; 248/317, 343
See application file for complete search history.

(56) References Cited

U.S. PATENT DOCUMENTS 3,233,297 A * 2/1966 Havener ..... 403/397
3,608,857 A * 9/1971 Hibbeler ..... 248/317
4,122,762 A * 10/1978 Williams ..... 454/292
4,723,749 A * 2/1988 Carraro et al. ..... 248/317
5,001,967 A 3/1991 Hungerford
5,271,585 A * 12/1993 Zetena, Jr. ..... 248/49
5,433,662 A * 7/1995 Hungerford ..... 454/303
6,047,517 A * 4/2000 Vrame ..... 52/733.3
6,286,265 B1 * 9/2001 Rinderer ..... 52/28
6,341,466 B1 * 1/2002 Kehoe et al. ..... 52/712
6,345,800 B1 * 2/2002 Herst et al. ..... 248/342
6,554,231 B2 * 4/2003 Choi ..... 248/65
2008/0110122 A1 * 5/2008 Lehane et al. ..... 52/506.07

OTHER PUBLICATIONS

USG Corporation Drawing No. 8970; Prior Art V-Series Spreader Clip, apparent date May 21, 1997.

* cited by examiner

*Primary Examiner*—Richard E Chilcot, Jr.
*Assistant Examiner*—Brent W Herring
(74) *Attorney, Agent, or Firm*—Pearne & Gordon LLP

(57) ABSTRACT

A clip for accurately and quickly suspending pairs of spaced parallel grid main tees from superadjacent structural channels. The clip works with a separate drop clip that hooks over and depends from the structural channel. The paired main tee clip has a central body region configured like a conventional grid tee bulb thereby enabling the paired main tee clip to mate with the drop clip in the same way the drop clip mates with a conventional grid tee bulb thereby achieving a system that is cost-effective in manufacture and installation.

7 Claims, 4 Drawing Sheets

PAIRED MAIN TEE CLIP

BACKGROUND OF THE INVENTION

The invention relates to suspended ceiling systems and, in particular, to a novel clip for suspending a pair of main tees in parallel relation.

PRIOR ART

Certain ceiling treatments or designs utilize main tees in relatively closely spaced pairs to give a ceiling a distinctive appearance and/or to provide an intermediate space for lighting, HVAC systems, sprinkler systems and like services. It is known to use a series of special clips to support a pair of main tees in parallel relation. Such clips, typically, are suspended directly from overhead structure by steel wire. In certain geographic areas, local codes or requirements prohibit suspended ceilings from being suspended from overhead structure directly by plain wire ties. For example, in some areas, a C-channel must first be hung from the overhead structure and a suspended ceiling, fixtures and-like elements must be hung from these intermediate channels. As far as is known, there are no available clips or brackets that can be easily and quickly attached to the suspension channels that, in turn, can support a pair of main tees in a uniform parallel spacing.

SUMMARY OF THE INVENTION

The invention provides a clip that is compatible with overhead channel suspension and which supports a pair of grid main tees in precise parallel alignment. The clip of the invention is easy to use and thereby saves installation time and avoids fatigue on the part of the installer.

In its preferred form, the clip is arranged to work with prior art "drop clip" hangers compatible with the required overhead suspension channels. As disclosed, the clip is coupled to a hanger with simple manipulation of the hanger and clip elements without the need for the use of tools and/or separate fasteners. The compatibility of the disclosed clip with conventional drop clip C-channel hangers significantly reduces the cost and complexity of the tooling required to make the clip and, therefore, reduces the costs involved in making the clip. Additionally, the clip affords the known benefits of similar clips in producing a uniform spacing between the grid tee pairs which spacing is critical since variations are conspicuous to even the casual observer.

DESCRIPTION OF THE PREFERRED EMBODIMENT

Figure 1:
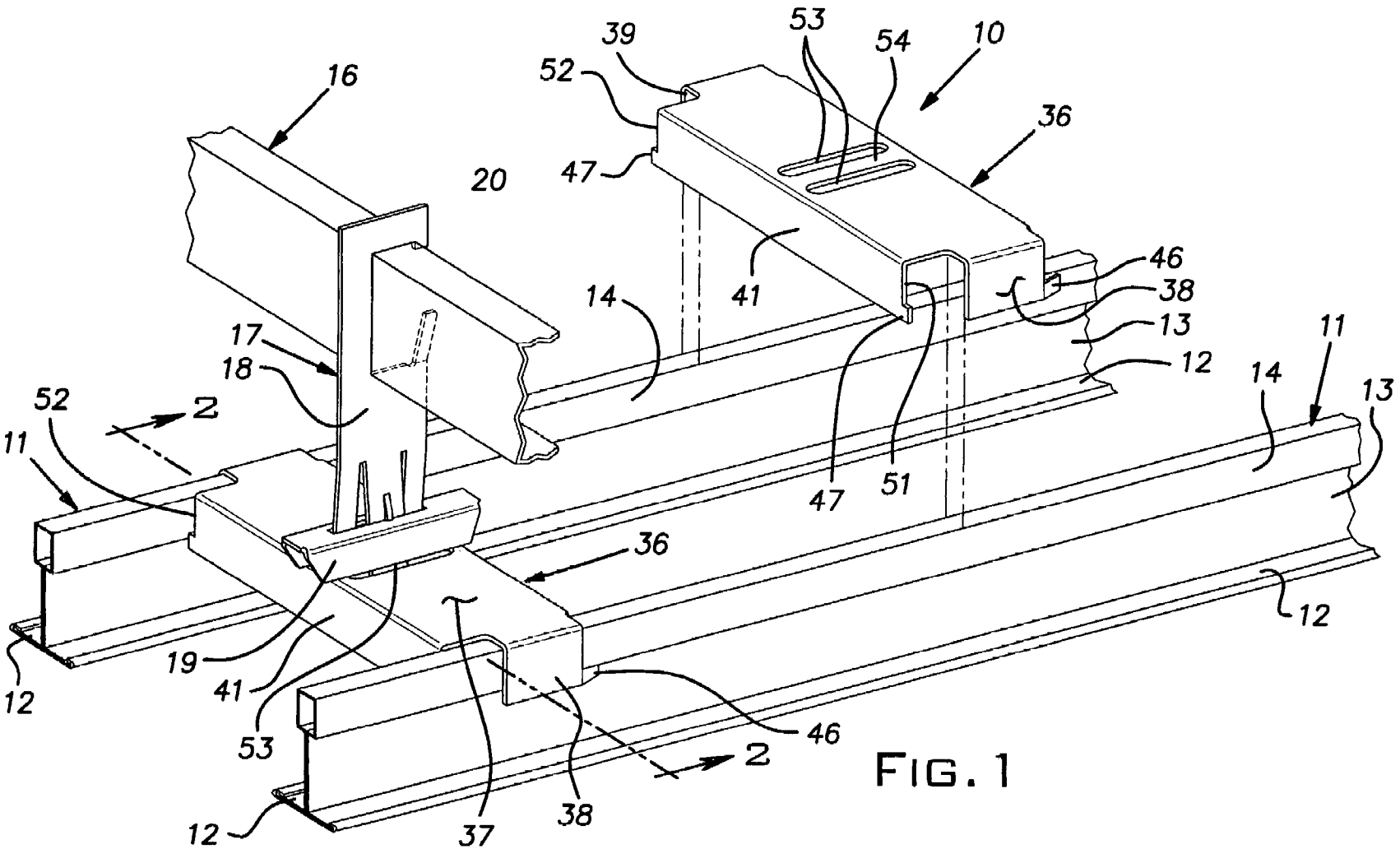
FIG. 1 is a perspective fragmentary view of a pair of parallel grid tees supported by the clip of the invention from an overlying suspended structural channel.

A system 10 for suspending a pair of grid tees 11 in a uniformly spaced parallel arrangement is shown in FIG. 1.

The grid tees 11, typically, are main tees with a generally conventional construction. Each of the tees 11 has lower flange portions 12 and a generally vertical web or stem 13 which includes, adjacent its upper edge, a reinforcing bulb 14, as is customary. Typically, the grid tees are roll formed of sheet metal stock. The grid tees are suspended from a plurality of structural channels 16. Only one channel 16 is illustrated in FIG. 1, but it will be understood that a plurality of such channels 16, typically, spaced parallel to one another, exist in a common plane spaced above the plane of the grid tees 11. The channel 16 can be suspended in a building from the above floor or other superstructure existing above by means of suspension rods, wires, or the like.

Figure 2:
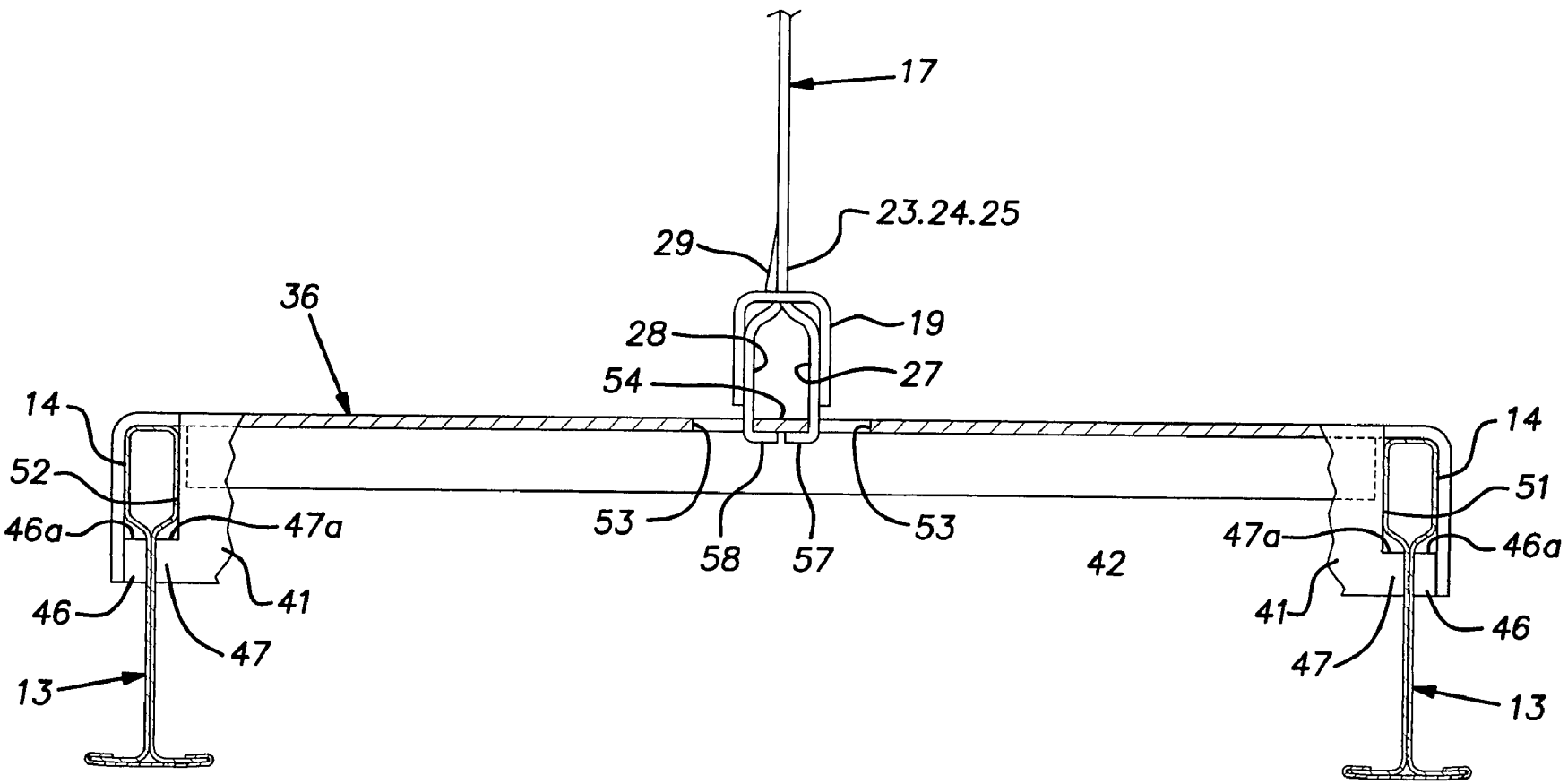
FIG. 2 is a cross-sectional view of the spaced parallel grid tees and clip taken in the plane 2-2 indicated in FIG. 1.
Figure 5:
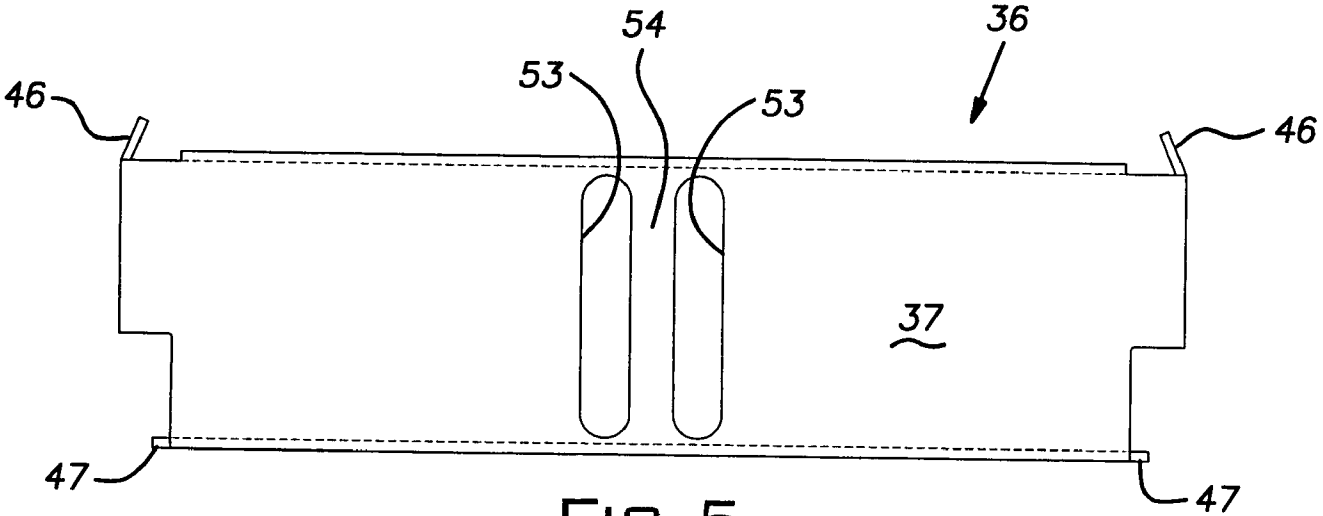
FIG. 5 is a plan view of the clip.
Figure 4:
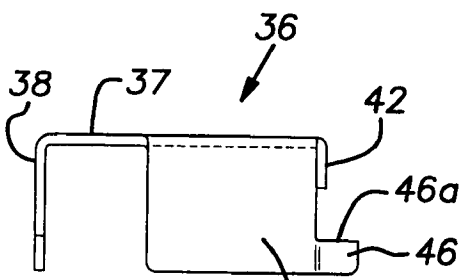
FIG. 4 is a side view of the clip.
Figure 3:
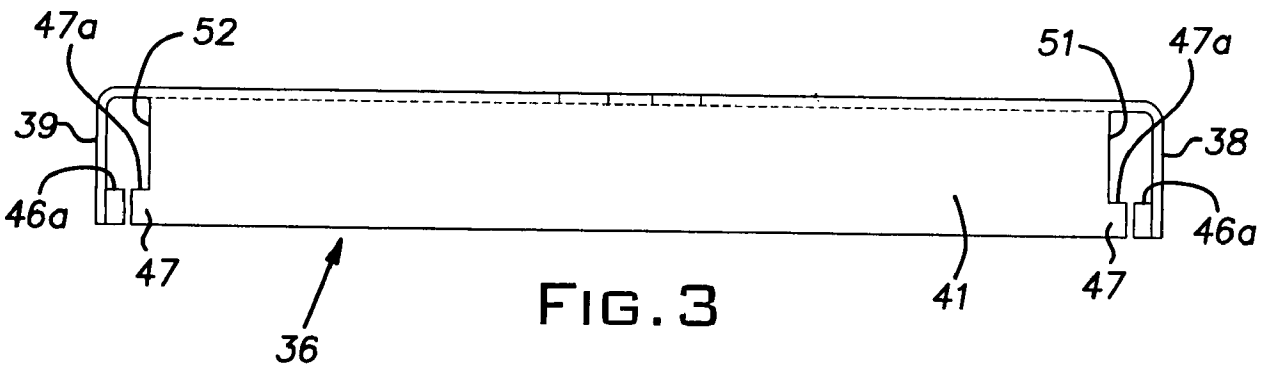
FIG. 3 is an elevational view of the clip of the invention.
Figure 6:
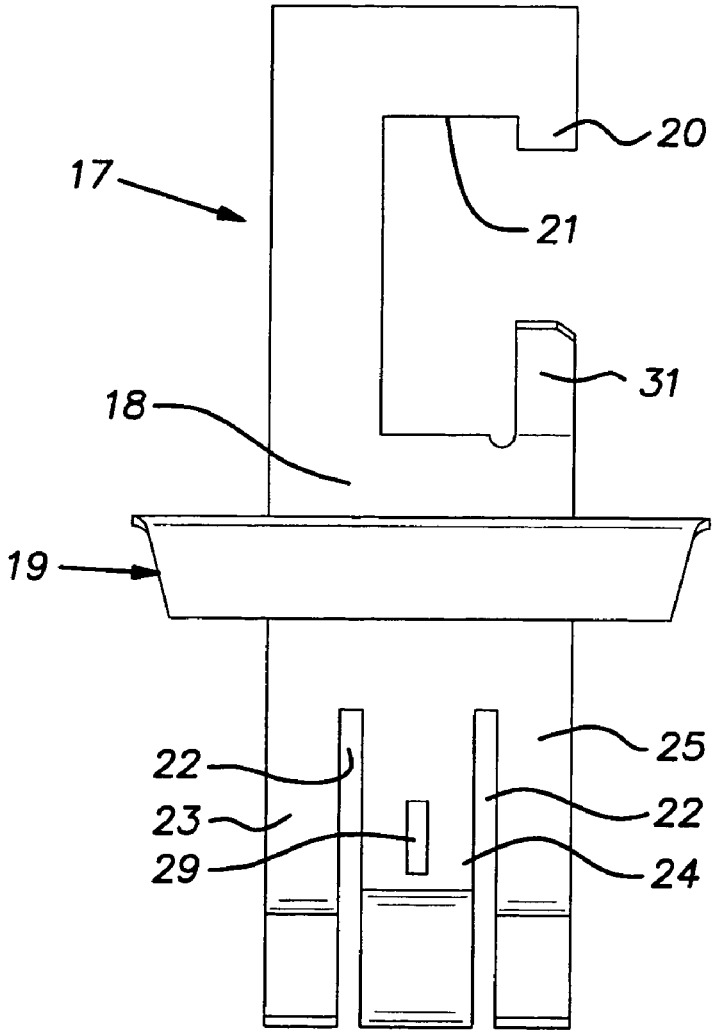
FIG. 6 PRIOR ART
FIG. 6 is a side elevational view of a known drop clip assembly.
Figure 7:
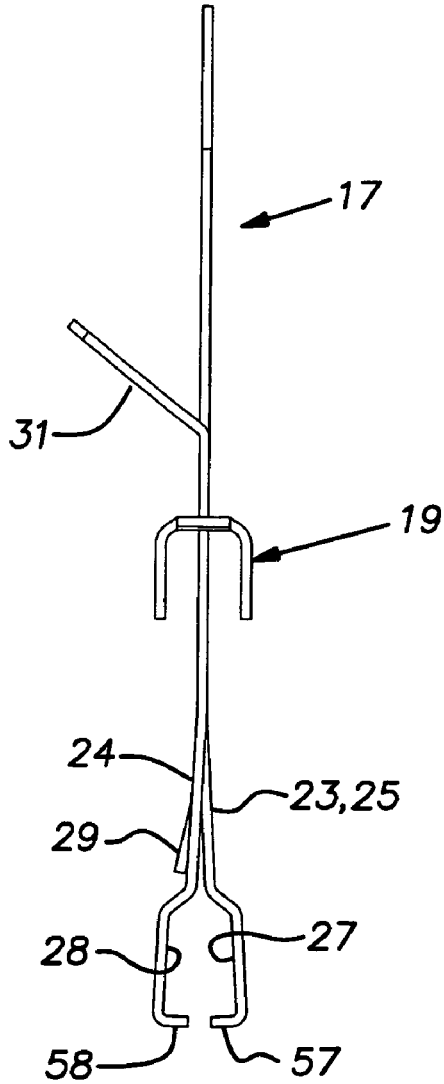
FIG. 7 PRIOR ART
FIG. 7 is a side edge view of the known drop clip assembly.

FIGS. 6 and 7 illustrate a commercially available "drop clip" assembly 17 that includes a main body 18 and a locking channel or cap 19. The main body 18 is a sheet metal stamping with a generally rectangular peripheral profile. A downwardly extending tab 20 works with the throat 21 to form a hook that captures the channel 16. Adjacent its upper end, the body 18 has a rectangular throat 21 sized to provide a working clearance around the periphery of the structural channels 16. Adjacent its lower end, the body 18 has a pair of parallel vertical slots 22 that leave three depending legs 23-25. Outboard legs 23, 25 are bent slightly below the plane of the drawing of FIG. 6, while a central leg 24 is bent slightly above the plane of FIG. 6. At their lower ends, the legs have channel shape formations 27, 28, that are configured to normally embrace the reinforcing bulb of a conventional grid tee. The locking channel cap 19 has a central slot in its web that enables it to slide vertically on the clip body 18. When the locking channel cap 19 is manually forced downwardly over the legs 23-25, including the channel formations 27, 28, the channel formations are forced towards the central plane of the upper portion of the body 18 (FIG. 2). A lanced formation 29 on the central leg 24 serves to lock the locking channel cap 19 in position over the leg channel formations 27, 28. With the clip assembly 17 being manipulated onto a respective channel 16 so that it is received in the throat 21, a section 31 of the body 18 can be bent upwardly to trap the clip assembly onto the channel.

A clip 36 of the invention serves to suspend the grid tees 11 from the drop clip body 18 and, therefore, from the structural channel 16 to which the drop clip assembly 17 is attached. The clip 36, in the illustrated form, is a sheet metal stamping having the general form, when installed, of an inverted rectangular pan. The corners of the clip 36 are notched as required for receiving the bulbs 14 of the grid tees 11. More particularly, the clip 36 has a generally planar, rectangular main section 37 from which depend downwardly bent opposed flanges 38, 39 and 41, 42. The flanges 38, 39 are mirror images of one another and each includes an inwardly bent tab 46 spaced vertically below the main section 37 a distance at least equal to and preferably slightly greater than the vertical height of the reinforcing bulb 14 of a grid tee. Another flange 41, extending transversely between the imaginary planes of the flanges 38, 39, includes a pair of tabs 47 spaced from the plane of the main section 37 a distance equal to or slightly greater than the height of a reinforcing bulb 14. The flanges 41 and 42 serve to stiffen the main section 37 of the clip 36 and keep it in a planar configuration under normally expected service conditions. The horizontal lengths of the flanges 41, 42 are somewhat less than the inside dimension between the opposed flanges 38, 39 so that, as shown in FIG. 2, there is room, preferably with a slight clearance, for the grid tee bulbs 14 to be received between the surface of a flange 38, 39, and adjacent vertical end edge surfaces 51, 52 on the flange 41. The inside dimension spacing of the surfaces of the flanges 38, 39 and the spacing between the vertical edge surfaces 51, 52, are determined by the desired center-to-center distance between the grid tees 11 and the width of the reinforcing bulbs 14, typically the latter being nominally ¼". As suggested in FIG. 2, the upper edge surfaces 46*a*, 47*a* of the tabs 46, 47 are spaced from the lower surface of the main section 37 a distance sufficient to receive the bulbs 14 of the grid tees. For illustrative purposes, end areas of the flange 41 and tabs 47 are shown in FIG. 2, ignoring the fact that the plane of the section of FIG. 2 is technically behind these areas.

Disposed on opposite sides of an imaginary vertical mid-plane transverse to its length, the clip 36 has a pair of elongated transverse slots 53. In the illustrated example, the slots 53 extend across substantially the full width of the clip main section 37. The slots 53 are spaced from one another to leave a central land portion 54 that, preferably, has a width equal or substantially equal to the width of a conventional reinforcing bulb 14, for example, nominally ¼". The slots 53 are sufficiently wide and long to allow the free passage therethrough of the channel formations 27, 28 of the drop clip legs 23-35.

The clip 36 is joined and locked, i.e. coupled, to the drop clip assembly 17 in the following manner, conveniently at the job site by the grid installer without tools. The drop clip legs 23-25, in their laterally spread condition shown in FIG. 7, are inserted through the slots 53 so that in-turned flanges 57, 58 of the channel formations 27, 28 underlie the land 54 of the main clip section 37. Thereafter, the locking channel cap 19 is forced downwardly relative to the drop clip body 18 so as to force the legs 23, 25 towards the central leg 24 and vice versa thereby trapping the land 54 in the channel formations 27, 28 above the flanges 57, 58. When the channel cap 19 fully contacts the channel formations 27, 28, it is locked in this position by the lance or lock 29. As a consequence, the drop clip assembly 17 and paired tee clip are securely fixed together. Study of FIGS. 1 and 2 shows that the interconnection of the clips 17 and 36 is symmetrical about imaginary vertical planes, one at a mid-plane through the thickness of the main body 18 of the drop clip and another perpendicular to the plane of the main body midway between its vertical edges. This results in a symmetrical support of the paired tee clip 36 which, in turn, assures that each of the four tabs 46, 47 of the clip 36 at their upper surfaces 46*a*, 47*b* are effective in supporting the vertical load on the respective grid tee bulbs 14. It will be appreciated that the clip 36 in concert with identical clips spaced along the lengths of a pair of grid tees 11 can precisely horizontally space the pair of grid tees with minimal skill and effort expended on the part of the installer. The length of the clip 36, i.e. its extent on each side of the plane of the drop clip main body 18, can be adjusted to suit a particular installation as would ordinarily be determined by an architect, for example. The space between the parallel paired grid tees 11 can be utilized for lighting fixtures, HVAC air boots, sprinkler heads, speakers and other utilities and appliances.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A clip for suspending a pair of main grid tees in horizontally spaced parallel relationship to one another, the grid tees being of the type having the general configuration of an inverted tee and a reinforcing bulb of a predetermined width adjacent the upper edge of a central web, the clip including surface areas for gripping opposite generally vertical sides of the web of each of the spaced tees to thereby hold tees in respective relative horizontal positions, and surface areas for gripping lower portions of the bulbs to hold the tees in respective vertical positions, a main body portion extending generally horizontally between the gripping surface areas for the spaced tees, the main body portion including a central connector portion having a width in a direction parallel to the longitudinal dimension of said tees being substantially the width of the bulbs of the tees whereby the connector portion is gripped and suspended by a drop clip.

2. A method of hanging a pair of main grid tees in spaced parallel relation from a structural channel with its web oriented vertically and its flanges oriented horizontally, comprising assembling a sheet metal clip element on the channel with a throat of the clip enveloping at least portions of the vertical and horizontal faces of the channel, providing a sheet metal structure extending horizontally from the clip element adjacent its lower end a distance greater than the desired center-to-center spacing of the parallel grid tees, the sheet metal structure having a formation that has surface areas arranged to hold the bulbs of the spaced parallel tees in a manner such that the tees are maintained in their desired spaced parallel relation with the clip element centrally disposed between and above the tees, and gripping a central connector portion of the sheet metal structure having a width, in a direction parallel to the longitudinal dimension of the tees, being substantially the width of the bulbs of the tees.

3. A method as set forth in claim 2, wherein the sheet metal structure is arranged to extend generally symmetrically in opposite horizontal directions perpendicular to the longitudinal direction of the tees from said sheet metal clip.

4. In combination, a drop clip assembly having a sheet metal body with a throat for engaging the surfaces of a suspended structural channel and a depending portion extending below the channel, the depending portion having a set of legs arranged to grip the underside of a bulb of a conventional main grid tee from opposite sides, and a sheet metal spreader clip for coupling with the drop clip and suspending a pair of grid tees in spaced parallel relation, the spreader clip having a central portion having a width, in a direction parallel to the longitudinal dimension of the pair of tees, substantially the width of the bulbs of the pair of tees and gripped from opposite horizontal directions at least partially from below by said legs in a manner similar to the way said legs are capable of gripping the bulb of a conventional grid tee from opposite horizontal directions, the spreader clip having a set of surface elements arranged to suspend the pair of grid tees in said spaced parallel relation in directions perpendicular to said opposite horizontal directions of gripping.

5. The combination set forth in claim 4, wherein said surface elements are arranged to engage downwardly facing areas of said bulbs.

6. An apparatus for suspending a pair of grid tees in spaced parallel relation from a C-shaped structural channel suspended with its web in a vertical plane and its flanges at the upper and lower edges of the web in horizontal planes, the apparatus including a first metal body part preformed with a rigid hook for placement over the upper channel flange, a second metal body part depending from said first body part, the second body part having gripping elements for supporting a pair of grid tees in parallel relation with a predetermined spacing, said gripping elements including surfaces arranged to engage the underside of the upper reinforcing bulbs of conventional grid tees, said first and second body parts being separately formed and being field assembled together by the installer of a suspended ceiling grid, the first body part having a configuration designed to support a conventional grid tee by coupling with its reinforcing bulb and said second body part having a central connector portion having a width in a direction parallel to the longitudinal dimension of the tees being substantially the width of the bulbs of the tees whereby the connector portion is gripped and supported by said first body part configuration.

7. A clip for suspending a pair of main grid tees in horizontally spaced parallel relationship to one another, the grid tees being of the type having the general configuration of an inverted tee and a reinforcing bulb of a predetermined width adjacent the upper edge of a central web, the clip being made of a single sheet of sheet metal and including surface areas for gripping opposite generally vertical sides of the web of each of the spaced tees to thereby hold tees in respective relative horizontal positions, and surface areas for gripping lower portions of the bulbs to hold the tees in respective vertical positions, a main body portion extending generally horizontally between the gripping surface areas for the spaced tees, the main body portion including a connector portion having a width in a direction parallel to the longitudinal dimension of said tees being substantially the width of the bulbs of the tees whereby the connector portion is gripped and suspended by a drop clip.

* * * * *